United States Patent [19]

Lehew

[11] 4,019,736

[45] Apr. 26, 1977

[54] PROTECTIVE DEVICE FOR RACKETS

[76] Inventor: Donald L. Lehew, 13315 Flagstone, Dallas, Tex. 75240

[22] Filed: Oct. 14, 1975

[21] Appl. No.: 621,694

Related U.S. Application Data

[63] Continuation of Ser. No. 124,350, March 15, 1971, abandoned.

[52] U.S. Cl. ..... 273/73 R

[51] Int. Cl.[2] ..... A63B 49/14

[58] Field of Search ..... 273/73 R, 73 C, 73 D, 273/74, 73 H

[56] References Cited

UNITED STATES PATENTS

| | | | |
|---|---|---|---|
| 1,587,919 | 6/1926 | Morrison | 273/73 H |
| 3,048,399 | 8/1962 | Breitbach | 273/73 R X |
| 3,330,560 | 7/1967 | Higdon | 273/73 R |
| 3,582,072 | 6/1971 | Stueck | 273/73 D X |

FOREIGN PATENTS OR APPLICATIONS

| | | | |
|---|---|---|---|
| 29,305 | 9/1930 | Australia | 273/73 C |
| 1,214,951 | 11/1959 | France | 273/73 R |
| 29,330 | 12/1913 | United Kingdom | 273/73 C |
| 252,293 | 5/1926 | United Kingdom | 273/73 C |
| 253,705 | 6/1926 | United Kingdom | 273/73 C |
| 317,653 | 8/1929 | United Kingdom | 273/73 C |
| 751,040 | 6/1956 | United Kingdom | 273/73 C |
| 799,947 | 8/1958 | United Kingdom | 273/73 R |

*Primary Examiner*—Richard J. Apley
*Attorney, Agent, or Firm*—Kenneth R. Glaser

[57] ABSTRACT

A device for protecting a tennis racket from damage during use having a portion which conforms to the curvature of the frame of the racket and spaced resiliently biased fingers which clamp onto the frame to retain the device on the racket during use.

3 Claims, 5 Drawing Figures

INVENTOR
DONALD L. LEHEW

John J. Booth
ATTORNEY

PROTECTIVE DEVICE FOR RACKETS

This is a continuation, of application Ser. No. 124,350, filed 3-15-71, now abandoned.

BACKGROUND OF THE INVENTION

The present invention relates to devices for protecting the frame of a racket from damage during use and more particularly to a removable protective device which is light-weight and surrounds the frame of the racket to protect it from damage due to inadvertent contact with the court or other hard surface during use.

DESCRIPTION OF THE PRIOR ART

In the manufacture of rackets such as those used in the game of tennis, badminton, squash, and the like, it has been a general practice to construct the frame portion of the racket without suitable protective covering to prevent the frame from being damaged by inadvertent contact against a hard surface such as the wall or floor of the playing court. This damage to the frame can scar and mar the finish of the frame, thus detracting from the appearance of the racket, and can in some instances weaken the frame to the extent that it will warp or even break during use. In addition, there is the possibility that the strings of the racket can be broken due to this inadvertent contact between the frame and a hard surface, thus necessitating the restringing of the racket.

SUMMARY OF THE INVENTION

The general purpose of this invention is to provide a racket protector which not only protects the frame of the racket from damage during use from inadvertent contact with a hard surface, but also does not alter the racket's performance. To attain this, the present invention contemplates the use of a unique racket protector which is light-weight and can be easily attached to a plurality of types of rackets.

OBJECTS OF THE INVENTION

It is therefore an object of the present invention to provide a racket protector for preventing damage to the frame of the racket during use.

Another object of the present invention is the provision of a racket protector which can be quickly and easily attached to and removed from the racket.

A further object of the invention is the provision of a racket protector which is light-weight and durable.

Still another object of the present invention is the provision of a racket protector which is simple and inexpensive to manufacture and install.

An even further object of the present invention is the provision of a racket protector which does not alter the racket's performance.

Other objects and many of the attendant advantages of this invention will be readily appreciated by those of ordinary skill in the art as the same becomes better understood by reference to the following detailed description when considered in connection with the accompanying drawings, in which:

DESCRIPTION OF THE PREFERRED EMBODIMENT

Figure 1:
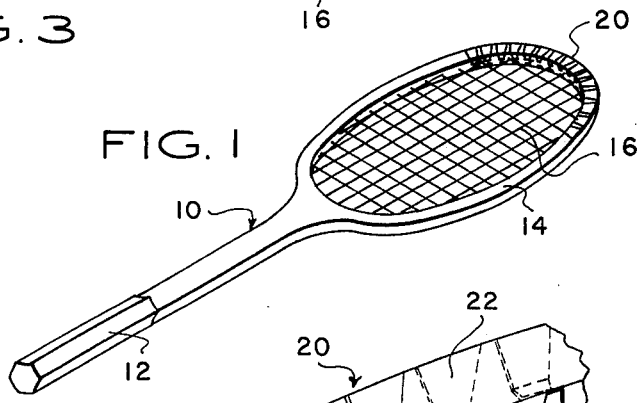
FIG. 1 is a perspective view of a racket with one embodiment of the racket protector attached thereto.
Figure 4:
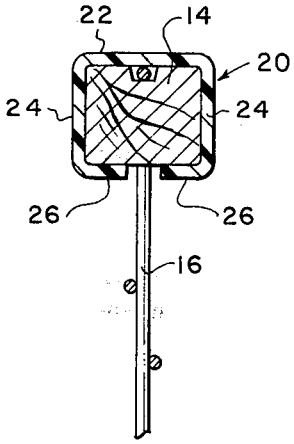
FIG. 4 is a section of the device taken on line 4—4 of FIG. 3 looking in the direction of the arrows.
Figure 5:
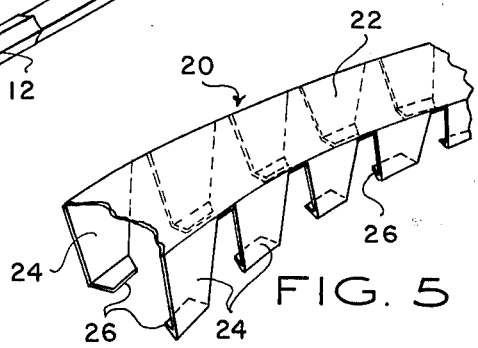
FIG. 5 is an enlarged perspective view of a portion of the racket protector.

Referring now to the drawings, wherein like referenced characters designate like or corresponding parts throughout the several views, there is shown in FIG. 1 a racket generally designated by reference numeral 10. This racket is of the type having a handle portion 12 which extends from an elliptical frame 14 with string network 16 strung on frame 14. One embodiment of the racket protector 20 of the present invention is shown attached to the portion of the frame 14 remote from the handle 12. Although in FIG. 1 the racket illustrated is of a tennis racket type, it is envisioned that protector 20 could be used on other types of rackets such as those used in the games of squash, badminton and the like.

The structure and method of attaching the protector 20 to the racket 10 will be described in detail by reference to FIGS. 2 through 5. As can be seen, the protector 20 is constructed with an elongated curved body 22 which fits over the exterior of the racket frame 14 and is provided with a plurality of trapezoid shaped fingers 24 extending from both sides. It is obvious that the fingers could have other shapes, such as square, rectangular, triangular or the like without detracting from the operation of the device and that the trapezoid shape is merely used for convenience. Specifically, this convenience is principally due to the fact that the trapezoidal shape of the fingers 24 (and end or keeper portions 26) facilitates attachment of the protector to the curved end portion of the racket frame in that the resulting space between adjacent fingers (due to the non-parallel opposed sides of each finger) enables relative movement therebetween. These fingers 24 furthermore transversely intersect, and are joined through, the strip portion 22 along loci of intersection coextensive with the opposed forward edges of frame 14 and extend radially inward from the body 22 so that they fit flush against the sides of the frame 14. Each of these fingers 24 has a portion 26 adjacent their end which is bent to extend at right angles to the fingers 24 to form a keeper which will lock under the frame 14 to retain the protector 20 on the racket 10.

The keeper portions 26 on opposite sides of the body 22 extend in a direction toward each other but are of a length so that their ends will not contact to form a gap or space therebetween. This gap or space creates a clearance opening through which the string network 16 can extend without contacting the protector 20.

Figure 2:
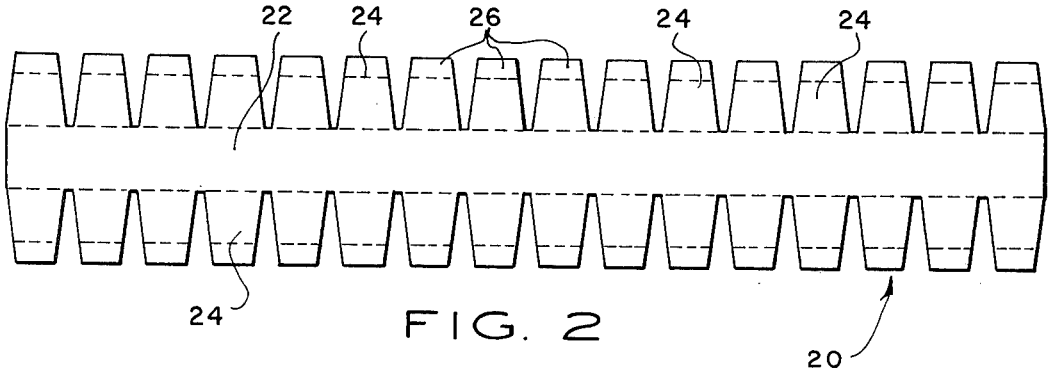
FIG. 2 illustrates a plan view of a pattern for forming the racket protector shown in FIG. 1 from a flat sheet of material.
Figure 3:
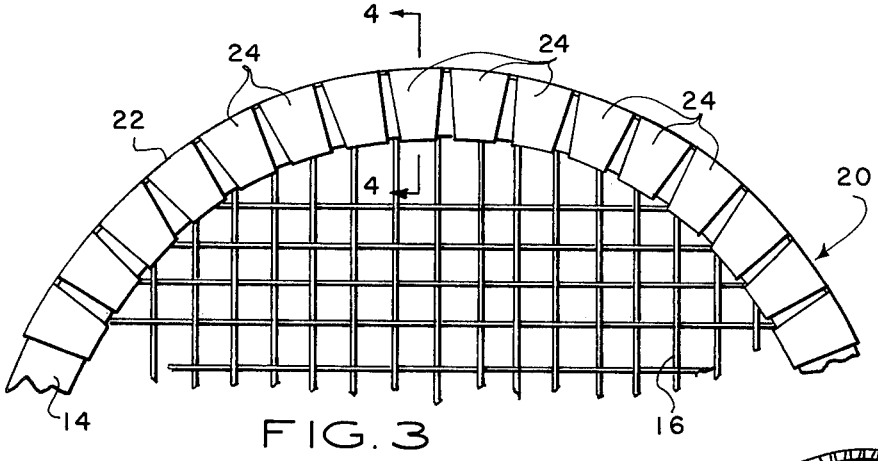
FIG. 3 is an enlarged side elevation view of a portion of a racket with a racket protector attached thereto.

It is contemplated that the protector of the present invention could be formed in one piece from any of a number of suitable flexible materials such as plastic or metal which will allow the fingers 24 and portions 26 to deflect and be snapped over and resiliently held onto the frame 14. The embodiment described herein could be formed as shown in FIG. 2 from a flat sheet of material with fingers 24 being formed by cutting the material and thereafter bending to the desired cross section and curved shape. It is also anticipated that the device could be performed by extrusion, thus eliminating the bending operations.

Obviously, many modifications and variations of the present invention are possible in light of the above teachings. It is therefore to be understood that within the scope of the appended claims, the invention may be practiced otherwise than as specifically described.

What is claimed and desired to be secured by United States Letters Patent is:

1. In combination:

a. a racket of the type including a handle and a string network frame having a curved end portion forward of said handle, and b. a protective device removably attached to said curved end portion, said device comprising a one-piece resilient body adapted to snap over said curved end portion and defined by an elongated strip substantially coextensive with, and disposed flush against, the forward end of said curved end portion, a plurality of fingers transversely intersecting said elongated strip solely along loci of intersection coextensive with the opposed edges of said forward end of said curved end portion, adjacent ones of said fingers being joined together through said elongated strip solely at said loci of intersection and being otherwise spaced apart a sufficient distance to enable relative movement between adjacent fingers during attachment to said curved end portion, and keeper portions transversely intersecting respective end portions of said fingers gripably engaging the underside of said curved end portion, said fingers and keeper portions being of a trapezoid configuration and arranged in paired sets, each keeper portion of a paired set being spaced apart from, but mutually aligned with, the other keeper portion of said paired set; whereby said plurality of fingers and keeper portions provide the sole means for attaching said protective device to the curved end portion of said racket.

2. The combination as defined by claim 1 wherein said keeper portions are preformed in said transversely intersecting position.

3. A protective device for removable attachment to the curved end portion of the string network frame of a racket of the type including a handle and said string network frame, said protective device being a one-piece resilient body adapted to snap over said curved end portion and comprising:

a. an elongated strip so formed to be substantially coextensive with, and disposed flush against, the forward end of said curved end portion, b. a plurality of fingers transversely intersecting said elongated strip along loci of intersection which, when said protective device is attached to said curved end portion, are coextensive with the opposed edges of said forward end of said curved end portion, adjacent ones of said fingers being joined together through said elongated strip solely at loci of intersection and being otherwise spaced apart a sufficient distance to enable relative movement between adjacent fingers during attachment to said curved end portion, and c. keeper portions transversely intersecting respective end portions of said fingers and adapted to gripably engage the underside of said curved end portion, said fingers and keeper portions being of a trapezoidal configuration and arranged in paired sets, each keeper portion of a paired set being spaced apart from, but mutually aligned with, the other keeper portion of said paired set; whereby said plurality of fingers and keeper portions provide the sole means for attaching said protective device to the curved end portion of said racket.

* * * * *